United States Patent [19]

Kondo et al.

[11] Patent Number: 4,821,475

[45] Date of Patent: Apr. 18, 1989

[54] DUCT MOUNTING STRUCTURE FOR PREFABRICATED CURTAIN WALL WITH AIR CONDITIONING SYSTEM

[75] Inventors: Hiroshi Kondo; Toshimasa Kusunoki, both of Funabashi; Ryo Kameda, Chiba, all of Japan

[73] Assignee: Yoshida Kogyo K. K., Tokyo, Japan

[21] Appl. No.: 93,044

[22] Filed: Sep. 4, 1987

[30] Foreign Application Priority Data

Sep. 8, 1986 [JP] Japan ..... 61-136692[U]

[51] Int. Cl.[4] ..... E04H 1/00

[52] U.S. Cl. ..... 52/235; 52/209

[58] Field of Search ..... 52/235, 209; 49/DIG. 1

[56] References Cited

U.S. PATENT DOCUMENTS

| | | | |
|---|---|---|---|
| 4,523,518 | 6/1985 | Gartner | 52/235 X |
| 4,531,336 | 7/1985 | Gartner | 52/235 X |
| 4,535,833 | 8/1985 | Gartner | 52/731 X |
| 4,561,225 | 12/1985 | Gartner | 52/220 |
| 4,619,091 | 10/1986 | Gartner | 52/398 X |

FOREIGN PATENT DOCUMENTS 59-163009 7/1984 Japan .

*Primary Examiner*—David A. Scherbel
*Assistant Examiner*—Creighton Smith
*Attorney, Agent, or Firm*—Hill, Van Santen, Steadman & Simpson

[57] ABSTRACT

In order to enable piping work associated with the duct mounting to the carried out easily, to obtain a large heat radiation area, and to enhance the efficiency of the heat radiation, there is provided a duct mounting structure for a prefabricated curtain wall with an air conditioning system having a frame body for a curtain wall unit formed by left and right hollow vertical member, upper and lower horizontal members, all of which are constituted of metallic extruded section members and which are framed with one another in a rectangular shape, and a hollow horizontal muntin constituted of a metallic extruded section member extending transversely between the left and right hollow vertical member and connected thereto. Respective hollow inside portions of the frame body constructing members and the horizontal muntin are arranged to intercommunicate so as to cause conditioned air to flow through a duct into the hollow inside portions. The conditioned air is blown out to a room through an outlet formed continuously in the horizontal muntin. Further, the frame body constructing members and the horizontal muntin have auxiliary hollow portions intercommunicating with each other and formed on their respective indoor sides, respectively, so as to cause heat transmitting medium to flow therethrough.

5 Claims, 9 Drawing Sheets

DUCT MOUNTING STRUCTURE FOR PREFABRICATED CURTAIN WALL WITH AIR CONDITIONING SYSTEM

BACKGROUND OF THE INVENTION

1. Field of the Invention

This invention relates to a curtain wall wherein each of the frame bodies for curtain wall units is formed by framing hollow vertical and horizontal members being constituted of extruded section members of a metal such as aluminium or any of aluminium alloys, and in order to achieve indoor air temperature conditioning, the air for conditioning such as cold air or hot air, or the air to be conditioned and the heat transmitting medium such as cold water or hot water etc. are allowed to flow through the hollow portions of the vertical and horizontal members to thereby enable the heat radiation by the frame bodies and the conditioned air blown out to a room from the outlets formed in the horizontal members to be utilized, and more particularly to a duct mounting structure for a prefabricated curtain wall adapted to supply the air for conditioning into the hollow portions of the vertical and horizontal members.

2. Description of the Prior Art

For example, in the prior art duct mounting structure for a curtain wall disclosed in the Japanese Utility Model Application Laid-open Specification No. 59-163009, the frame body of each curtain wall unit is formed by vertical and horizontal members of a metallic extruded section members having a first hollow portion and a second hollow portion, the first and second hollow portions being arranged to intercommunicate, the arrangement being made such that the conditioned air is allowed to flow through the first hollow portion and the heat transmitting medium is allowed to flow through the second hollow portion whereby achieving indoor air temperature conditioning by utilizing the heat radiation by the frame body.

In case of this prior art duct mounting structure, the ducts for supplying the air to be conditioned are interconnected, respectively, at the upper ends of the left and right vertical members forming the frame body of each curtain wall unit, and the arrangement is made such that the air is allowed to flow from the hollow portions of the vertical members into the hollow portion of the lower horizontal member, and therefore the air is not allowed to flow through the hollow portion of the upper horizontal member. As a result, the area available for heat radiation is reduced by the area of the upper horizontal member which is not utilized for heat radiation.

Further, in the above-mentioned prior art duct mounting structure, two ducts need to be interconnected for each curtain wall unit, so that the cost becomes expensive and much labor is required to interconnect the ducts.

Still further, in case of the above-mentioned duct mounting structure, the ducts are located on the upper parts of the left and right vertical members of the frame body of each curtain wall units, and therefore two lengths of pipings need to be provided for these ducts thus requiring troublesome piping work, and also one of the pipings must be laid at such a position as to avoid interference with a stud thus rendering the piping work more troublesome. Stating in brief, in one curtain wall, the two adjoining curtain wall units need normally to be mounted between the two adjacent studs, which results in one of the pipings interfering with one of the studs. Therefore, one of the pipings must be bent for installation so as not to interfere with the stud.

SUMMARY OF THE INVENTION

The present invention has been devised in view of the above-mentioned prior art duct mounting structure, and particularly to eliminate the disadvantages thereof, and has for its first object to provide a duct mounting structure for a prefabricated curtain wall with an air conditioning system wherein it is only necessary to connect one duct for the frame body of each curtain wall unit so as to enable piping work associated with the duct mounting to be carried out easily thus reducing the cost of assembly.

Another object of the present invention is to provide a duct mounting structure for a prefabricated curtain wall with an air conditioning system wherein in addition to the heat radiation obtained by the left and right vertical members and the lower horizontal member, the heat radiation by the upper horizontal member can be achieved to thereby enlarge the heat radiation area.

To achieve the above-mentioned objects, in accordance with the present invention, there is provided a duct mounting structure for a prefabricated curtain wall with an air conditioning system, characterized in that it comprises a frame body for a curtain wall unit formed by left and right hollow vertical members, one length of hollow upper horizontal member and one length of lower horizontal member, all of which are constituted of metallic extruded section members and which are framed with one another in a square shape, and one length of hollow horizontal mounting comprised of a metallic extruded section member extending transversely between the left and right hollow vertical members and connected thereto, the hollow inside portions of the left and right vertical members, the upper horizontal member and the horizontal muntin being arranged to intercommunicate; an outlet adapted to blow out the conditioned air which is formed continuously in the horizontal muntin in the longitudinal direction thereof so as to communicate with the hollow inside of the latter; and one duct which is connected on one side with the hollow upper horizontal member at the longitudinal central part thereof to supply the air to be conditioned thereinto, and which is connected on the other side thereof through a piping with the air conditioning system.

Further, according to the present invention, there is provided a duct mounting structure for a prefabricated curtain wall with an air conditioning system, characterized in that the left and right hollow vertical members, the hollow upper horizontal member and the hollow horizontal muntin have auxiliary hollow portions formed on the indoor side thereof, respectively, the auxiliary hollow portions being arranged to intercommunicate so as to cause the heat transmitting medium to flow therethrough.

The above and other advantages, aspects and objects of the present invention will become apparent to those skilled in the art from the following detailed description in connection with the accompanying drawings in which preferred exemplary embodiments made in compliance with the principle of the present invention are shown.

DETAILED DESCRIPTION OF PREFERRED EMBODIMENTS

The first embodiment of the duct mounting structure for a curtain wall unit provided with an air conditioning system will first be described below with reference to FIGS. 1 to 4.

Figure 1:
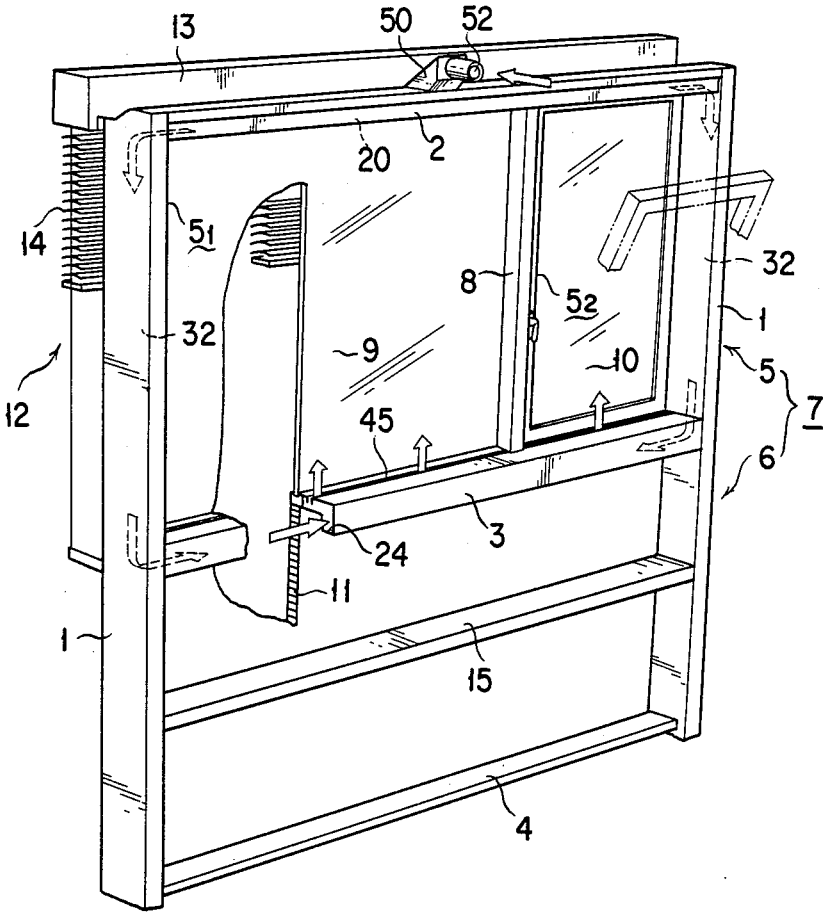
FIG. 1 is a schematic, overall perspective view of a curtain wall unit in which a first embodiment of the duct mounting structure according to the present invention is incorporated.
Figure 2:
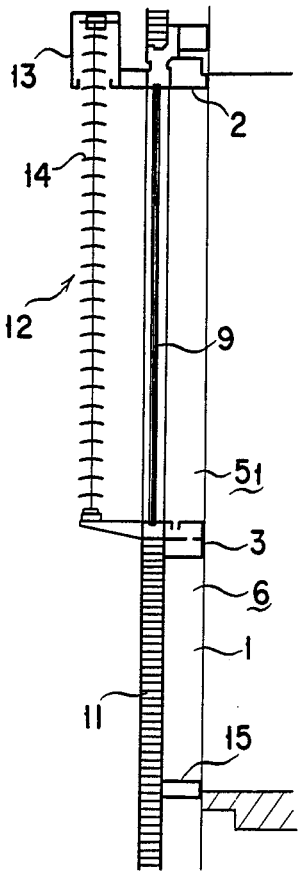
FIG. 2 is a schematic, longitudinal sectional view of the curtain wall unit shown in FIG. 1.

As shown in FIGS. 1 and 2, one curtain wall unit for a curtain wall provided with an air conditioning system comprises an upper horizontal member 2, a horizontal muntin 3 and a lower horizontal member 4, which are constituted of metallic extruded section members and which extend between left and right vertical members 1, 1 and are framed therewith, thereby forming a rectangular frame body 7 comprised of an upper frame section 5 and a lower frame section 6. A vertical, intermediate rib 8 is fixedly secured to the upper horizontal member 2 and the horizontal muntin 3 to thereby divide the upper frame section 5 into a first upper frame section $5_1$ and a second upper frame section $5_2$. The first upper frame section $5_1$ is fitted with a glass 9, whilst the second upper frame section $5_2$ is fitted with a window 10 which can be opened and shut. The lower frame section 6 is fitted with a heat-insulating panel member 11, whilst the upper frame section 5 has a louvre or Venetian blind 12 mounted on the outdoor side thereof.

The externally-mounted type louvre 12 is configured such that a blind case 13 is mounted on the outdoor side of the upper horizontal member 12 and a number of slats 14 are accommodated in the blind case 13 so that they can be moved up and down freely.

In FIG. 1, reference numeral 15 denotes a reinforcing horizontal member which is constituted of a metallic extruded section member also.

Figure 3:
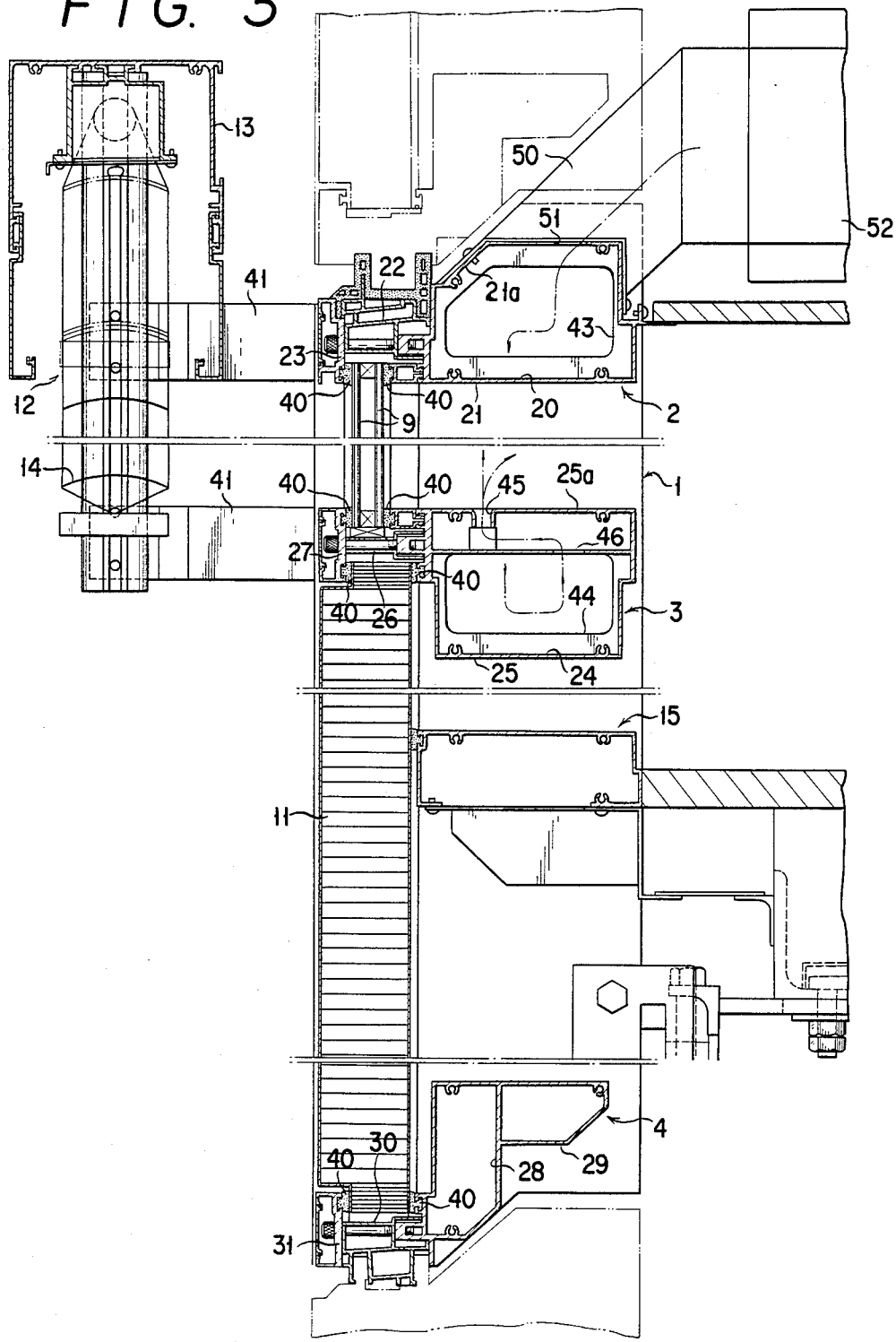
FIG. 3 is a detailed cross-sectional side view of the principal parts of the curtain wall unit shown in FIG. 1.
Figure 4:
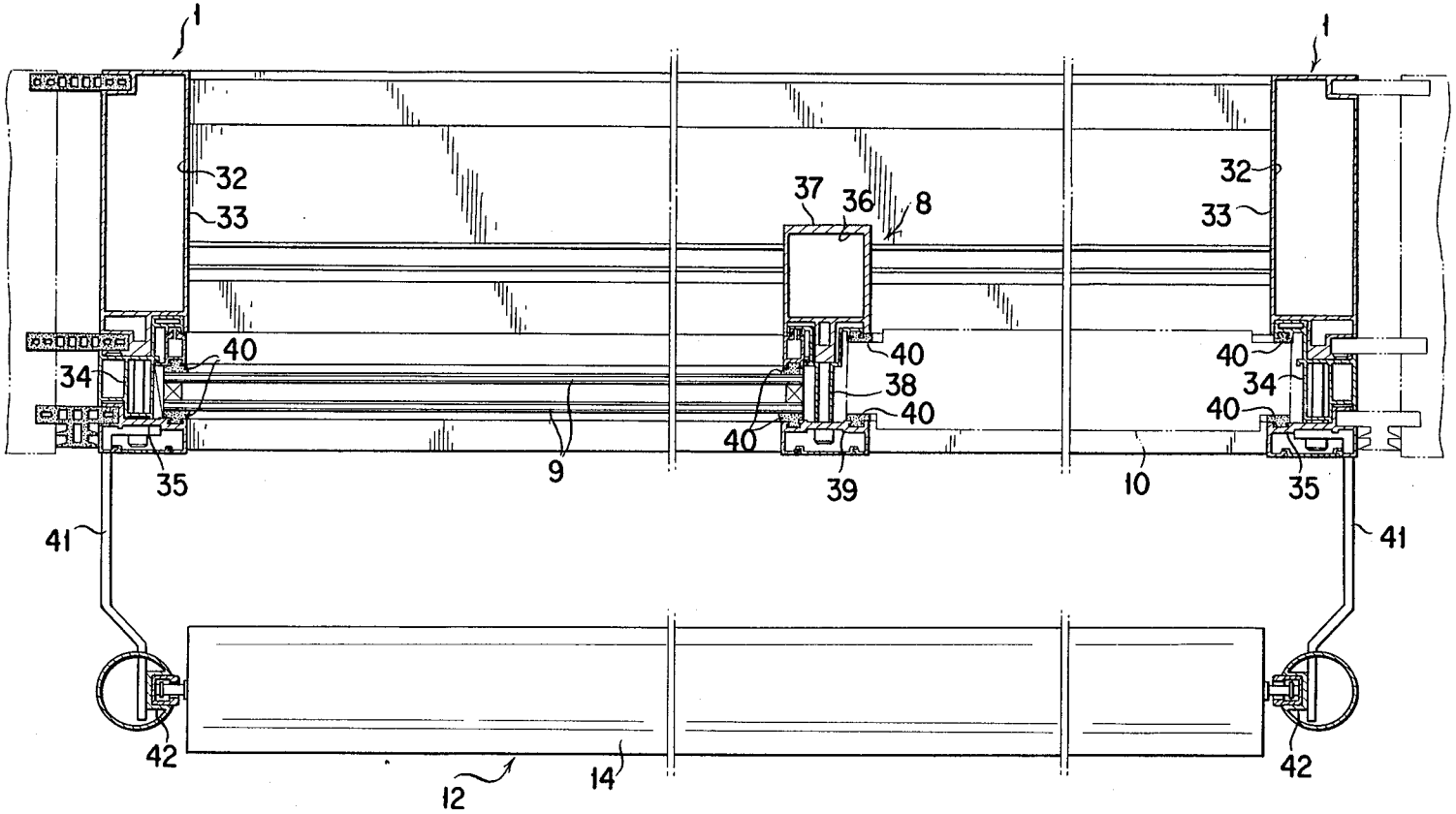
FIG. 4 is a detailed cross-sectional top view of the curtain wall unit shown in FIG. 1.

As shown in FIG. 3, the above-mentioned upper horizontal member 2 is comprised of a body 21 having a hollow portion 20 which is connected on the outdoor side thereof through a thermal insulation material 22 to a back-up member 23. The horizontal muntin or waist transum 3 is comprised of a body 25 having a hollow portion 24 which is connected on the outdoor side thereof through a thermal insulation material 26 to a back-up member 27. The lower horizontal member 4 is comprised of a body 29 having a hollow portion 28 which is connected on the outdoor side thereof through a thermal insulation material 30 to a back-up member 31. As shown in FIG. 4, each of the vertical members 1 is comprised of a body 33 with a hollow portion 32 which is connected on the outdoor side thereof through a thermal insulation material 34 to a back-up member 35. The vertical intermediate rib 8 is comprised of a body 37 having a hollow portion 36 which is connected on the outdoor side thereof through a thermal insulation material 38 to a back-up member 39.

The above-mentioned upper horizontal member 2, horizontal muntin 3, lower horizontal member 4, vertical members 1 and vertical intermediate rib are all comprised of extruded section members made of a metal such as aluminium or any of aluminium alloys etc. The glass 9, the window 10 which can be opened and shut, and the panel member 11 are fitted between the associated bodies and the back-up members through a sealing material 40.

The above-mentioned slats 14 for the blind 12 are carried so as to move up and down freely along blind guides 42 fitted to brackets 41 fixedly secured to the upper and lower parts of the back-up members 35 of the vertical members 1.

The hollow portion 20 of the above-mentioned upper horizontal member 2 is an opening 43 formed in each of the vertical members 1, which communicates with a hollow portion 32 of the vertical member 1. The horizontal muntin 3 has a hollow member 24 having an opening 44 formed in the vertical member 1 which communicates with the hollow portion 32 of the vertical member 1. The upper wall 25*a* of the body 25 of the muntin 3 is formed with a continuous, longitudinally extending slip-shaped outlet 45 for blowing out the conditioned air, the outlet 45 communicating through a hole 46 with the hollow portion 24. A duct 50 is connected with the longitudinally central part of the body 21 of the upper horizontal member 2; that is, the central part of the curtain wall unit. This duct 50 communicates through a through-hole 51 formed in the upper wall 21*a* of the body 21 with the hollow portion 20, and is connected through a piping 52 with an air conditioning system not shown so as to supply the conditioned air such as cold air or hot air etc. into the hollow portion 20.

Thus, the conditioned air is supplied from the duct 50 into the hollow portion 20 of the upper horizontal member 2 and then through the hollow portions 32 and 24 of the vertical members 1 ad the horizontal muntin 3, respectively, and is finally caused to flow out through the outlet 45, whereby enabling the room to be cooled or heated, i.e. air-conditioned by the heat radiation which is radiation of heat or endothermic effect from and towards the surfaces of the upper horizontal member 2, the vertical members 1 and the horizontal muntin 3.

A second embodiment of the duct mounting structure for the curtain wall with an air conditioning system will now be described below with reference to FIGS. 5 to 9.

In FIGS. 5 to 9, the component parts indicated with the same reference numerals as those used in FIGS. 1 to 4 have the same functions as those of the component parts of the first embodiment. Therefore, the description of the component parts of the second embodiment is omitted herein to avoid the duplication of explanation.

Figure 5:
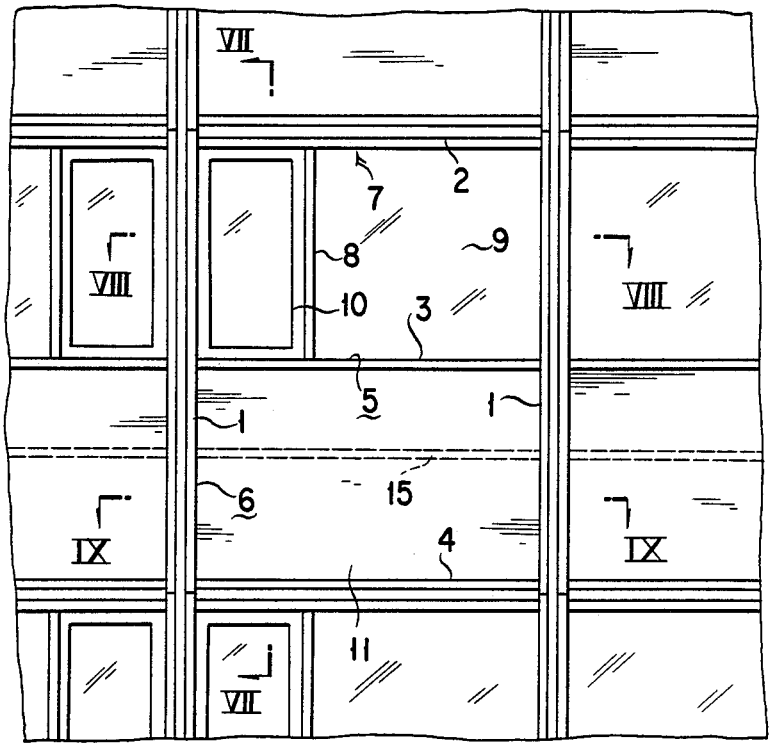
FIG. 5 is a schematic, fragmentary front view of a curtain wall in which a second embodiment of the duct mounting structure according to the present invention is incorporated.
Figure 6:
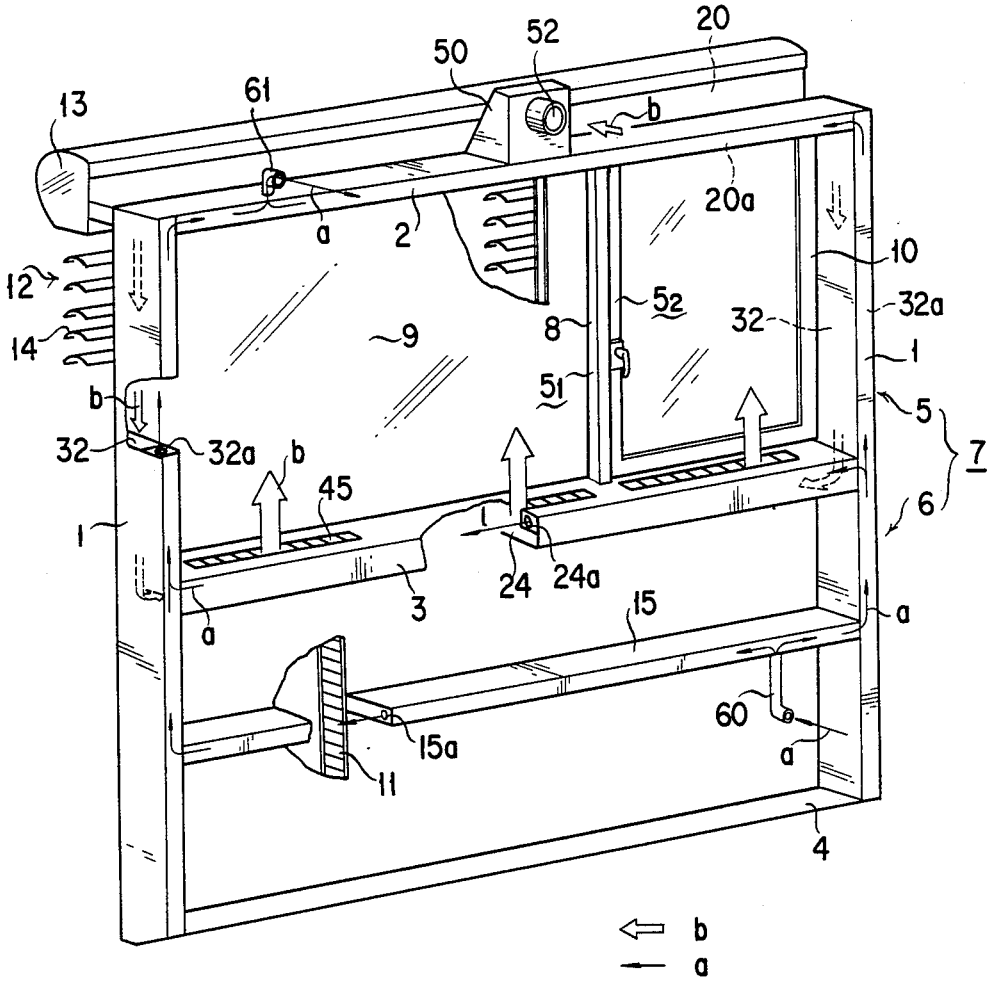
FIG. 6 is a schematic, overall perspective view of one curtain wall unit in which the second embodiment of the duct mounting structure of the present invention is incorporated.

FIG. 6 is a schematic, perspective view of one curtain wall unit forming a curtain wall with an air conditioning system which is shown as a schematic, fragmentary front view in FIG. 5, the curtain wall unit comprising the second embodiment of the duct mounting structure according to the present invention.

Figure 7:
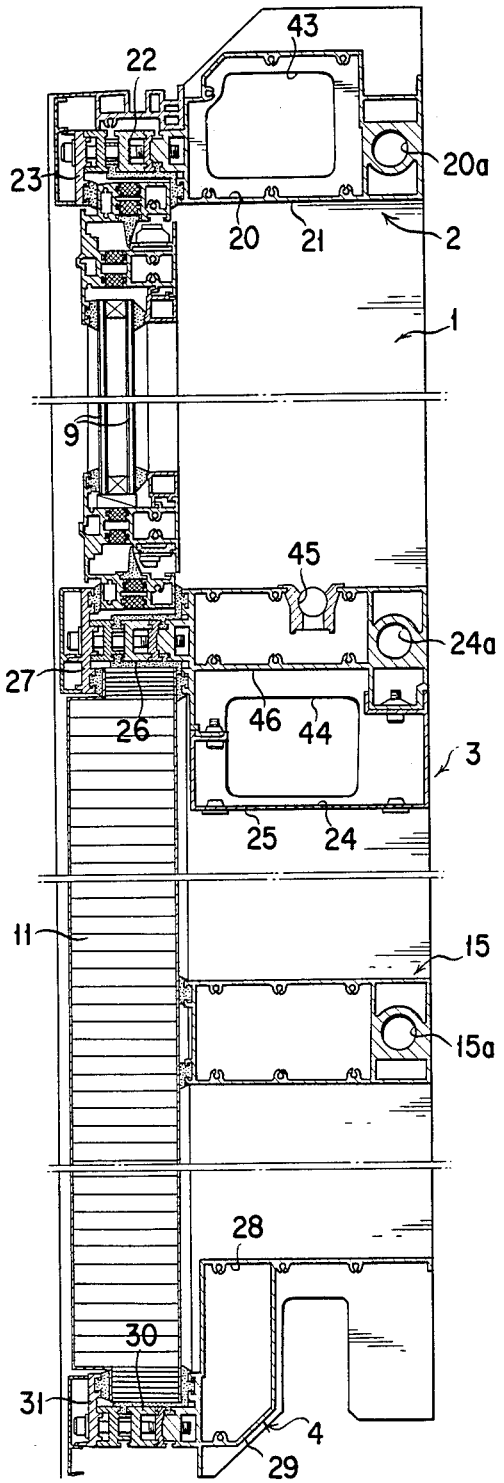
FIGS. 7, 8 and 9 are detailed sectional views of the curtain wall unit taken along lines VII—VII, VIII—VIII and IX—IX, respectively, in FIG. 5.
Figure 8:
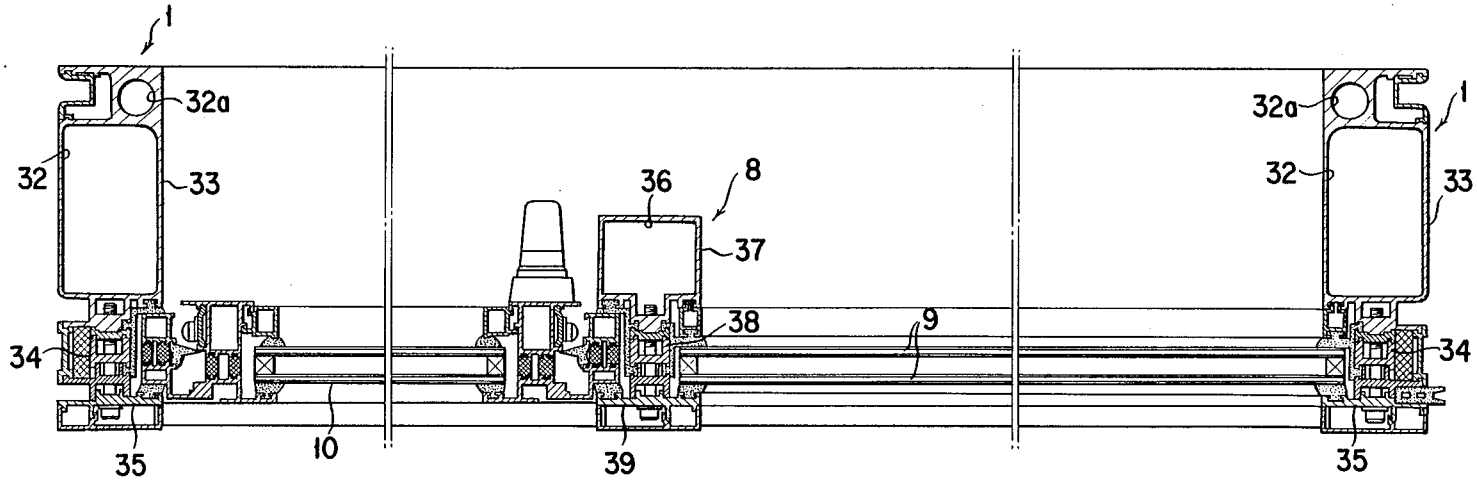
Figure 9:
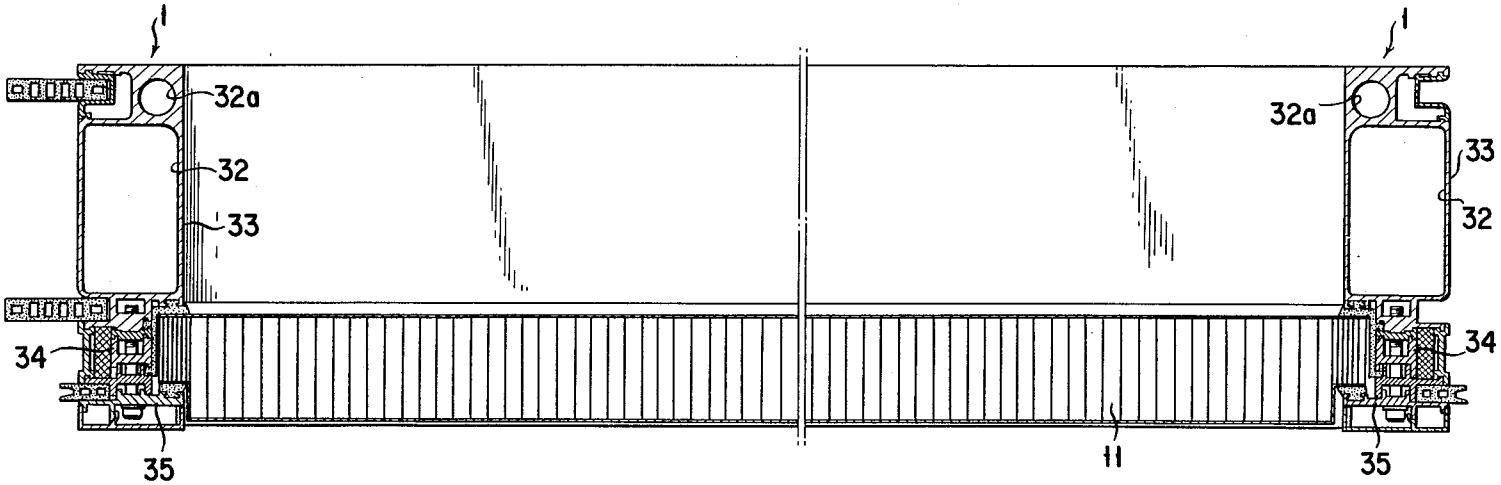

As shown in FIGS. 7 and 8 which are sectional views of the principal parts, the second embodiment of the duct mounting structure according to the present invention includes auxiliary hollow portions 32*a*, 20*a*, 24*a* and 15*a* of a circular cross-sectional shape formed, respectively, on the indoor side of the bodies 33, 33 of the left and right hollow vertical members 1, 1, the body 21 of the hollow upper horizontal member 2, the body 25 of the hollow horizontal muntin 3 and the hollow reinforcing horizontal member 15, the hollow portions 32*a*, 20*a*, 24*a* and 15*a* serving as passages for the heat transmitting medium. The auxiliary hollow portions 32*a*, 20*a*, 24*a* and 15*a* are arranged to intercommunicate. As shown in FIG. 6, a heat transmitting medium supply pipe 60 is connected with the auxiliary hollow portion 15*a* of the reinforcing horizontal member 15, whilst a heat transmitting medium recovery pipe 61 is connected with the auxiliary hollow portion 20*a* of the hollow upper horizontal member 2 so as to cause the heat transmitting medium such as cold water, hot water, etc. to flow through the auxiliary hollow portions as shown by arrow "a" in FIG. 6 whereby utilizing the heat radiation obtained thereby together with the air to be conditioned.

Whilst, in the same manner as that in the first embodiment, the air to be conditioned is allowed to flow through the hollow portions as indicated by arrow "b" in FIG. 6 and is caused to flow out through the outlet 45.

Thus, according to the duct mounting structure according to the second embodiment, the heat transmitting medium flowing through the auxiliary hollow portions will maintain efficiently the temperature of the air to be conditioned flowing through the hollow portions adjacent to the auxiliary hollow portions, whereby achieving more effective utilization of the heat radiation for air-conditioning.

What is claimed is:

1. A duct mounting structure for a prefabricated curtain wall with an air conditioning system, characterized in that the duct mounting structure comprises a frame body for a curtain wall unit formed by left and right hollow vertical members, one length of hollow upper horizontal member and one length of lower horizontal member, all of which are constituted of metallic extruded section members and which are framed with one another in a rectangular shape, and one length of hollow horizontal muntin constituted of a metallic extruded section member extending transversely between the left and right hollow vertical members and connected thereto. to, respective hollow inside portions of said left and right vertical members, said upper horizontal member and said horizontal muntin being arranged to intercommunicate; an outlet adapted to blow out the conditioned air and formed continuously in said horizontal muntin in the longitudinal direction thereof so as to communication with the hollow inside of the horizontal muntin; and only one air duct for each frame body which is connected on one side of a longitudinally central part of said hollow upper horizontal member to supply the air to be conditioned thereto, and which is connected on the other side thereof through a piping with the air conditioning system.

2. A duct mounting structure for a prefabricated curtain wall with an air conditioning system as claimed in claim 1, wherein said left and right hollow vertical members, said hollow upper horizontal member and said hollow horizontal munting have auxiliary hollow portions formed on their respective indoor sides, respectively, said auxiliary hollow portions being arranged to intercommunicate so as to cause heat transmitting medium to flow therethrough.

3. A duct mounting structure for a prefabricated curtain wall with an air conditioning system, characterized in that the duct mounting structure comprises a frame body for a curtain wall unit formed by left and right hollow vertical members, one length of hollow upper horizontal member and one length of lower horizontal member, all of which are constituted of metallic extruded section members and which are framed with one another in a rectangular shape, and one length of hollow horizontal muntin constituted of a metallic extruded section member extending transversely between the left and right hollow vertical members and connected thereto, respective hollow inside portions of said left and right vertical members, said upper horizontal member and said horizontal muntin being arranged to intercommunicate; at least one length of reinforcing horizontal member constituted of a metallic extruded section member and position between said horizontal muntin and said lower horizontal member so as to be connected to said left and right hollow vertical members; an outlet adapted to blow out the conditioned air and formed continuously in said horizontal muntin in the longitudinal direction thereof so as to communicate with the hollow inside of the horizontal muntin; and only one air duct for each frame body which is connected on one side of a longitudinally central part of said hollow upper horizontal member to supply the air to be conditioned thereinto, and which is connected on the other side thereof through a piping with the air conditioning system.

4. A duct mounting structure for a prefabricated curtain wall with an air conditioning system as claimed in claim 3, wherein said left and right hollow vertical members, said hollow upper horizontal member, said hollow horizontal muntin and said reinforcing horizontal member have auxiliary hollow portions formed on their respective indoor sides, respectively, said auxiliary hollow portions being arranged to intercommunicate so as to cause heat transmitting medium to flow therethrough.

5. A duct mounting structure for a prefabricated curtain wall with an air conditioning system as claimed in claim 4 wherein in order to allow the heat transmitting medium to flow through said auxiliary hollow portions, the duct mounting apparatus further comprises a heat transmitting medium supply pipe connected with the auxiliary hollow portion of the reinforcing horizontal member, and a heat transmitting medium recovery pipe connected with the auxiliary hollow portion of the hollow upper horizontal member.

* * * * *